United States Patent [19]

Brede et al.

[11] 4,445,434

[45] May 1, 1984

[54] ARRANGEMENT FOR THE CONTACTLESS TRANSMISSION OF ELECTRIC ENERGY TO MISSILES DURING FIRING THEREOF

[75] Inventors: Uwe Brede, Fürth; Gerhard Kordel, Nuremberg, both of Fed. Rep. of Germany

[73] Assignee: Dynamit Nobel Aktiengesellschaft, Troisdorf, Fed. Rep. of Germany

[21] Appl. No.: 277,863

[22] Filed: Jun. 26, 1981

[30] Foreign Application Priority Data

Jun. 28, 1980 [DE] Fed. Rep. of Germany ..... 3024554

[51] Int. Cl.³ ..... F42C 19/12

[52] U.S. Cl. ..... 102/206; 102/202

[58] Field of Search ..... 102/202, 202.1, 202.2, 102/202.5, 206, 207, 209, 218, 220, 205; 89/28 R

[56] References Cited

U.S. PATENT DOCUMENTS

| | | | |
|---|---|---|---|
| 2,459,854 | 1/1949 | Swift, Jr. | 102/209 |
| 3,670,653 | 6/1972 | Lunt et al. | 102/218 |
| 3,809,964 | 5/1974 | Ceyrat | 102/205 |
| 4,145,968 | 3/1979 | Klein | 102/202 |
| 4,145,970 | 3/1979 | Hedberg et al. | 102/206 |
| 4,207,796 | 6/1980 | Warnock | 89/28 R |
| 4,350,096 | 9/1982 | Cannavo et al. | 102/209 |

FOREIGN PATENT DOCUMENTS

| | | | |
|---|---|---|---|
| 1235844 | 6/1971 | United Kingdom | 102/206 |

*Primary Examiner*—Charles T. Jordan

*Attorney, Agent, or Firm*—Antonelli, Terry & Wands

[57] ABSTRACT

An arrangement for the contactless transmission of electrical energy to a missile during the firing thereof from a firing device including a transformer-like coil system having a primary coil system connected to the firing device and a secondary coil system connected to the missile. The primary coil system is supplied with electric energy and the secondary coil system is responsive to the electric energy developed in the primary coil system for developing electrical energy therein. A partition is arranged between the primary coil system and the secondary coil system and is formed of a nonmagnetic material capable of withstanding thermal and mechanical stresses of repeated firings by the firing device. The partition is fixedly connected with the firing device and disposed for sealing the primary coil system with respect to the missile at least during the firing of the missile from the firing device.

20 Claims, 4 Drawing Figures

ARRANGEMENT FOR THE CONTACTLESS TRANSMISSION OF ELECTRIC ENERGY TO MISSILES DURING FIRING THEREOF

The present invention relates to an arrangement for the contactless transmission of electric energy to missiles during the firing thereof.

It is known that electrical detonators can be activated by an alternating-current voltage induced in the secondary circuit of a coil system according to the transformer principle. A possible arrangement for this purpose is described in DOS [German Unexamined Laid-Open Application] No. 2,734,169. In this connection, the coil system on the secondary side, connected to the projectile, is accommodated in a housing made of a good electrically conductive material effecting electrostatic shielding as a Faraday cage. Furthermore, to provide magnetic shielding with respect to external electromagnetic interference fields, the secondary coil system is equipped with a shielding plate of magnetically saturable iron on its side located opposite to the primary coil system in the operative position, i.e., during firing. The coil system on the primary side is provided in a housing connected to the firing device, this housing being arranged in the firing device such as a firearm barrel or launching tube, in such a way that the coil system on the primary side opposes, during firing, the coil system of the projectile on the secondary side at a small spacing without a separating partition. For this purpose, the housing of the primary control circuit is open at the side facing the secondary system, and the firearm barrel is equipped with a corresponding perforation in its wall so that the coil system on the primary side is directly connected to the combustion chamber of the firing device. However, this arrangement has the effect that the primary control circuit is fully exposed to the thermal and mechanical stresses occurring during firing, so that the perfect functioning of this arrangement during repeated firings is not ensured.

It is, therefore, an object of the present invention to provide an arrangement for the contactless transmission of electrical energy to missiles during the firing thereof from a firing device, the arrangement utilizing a transformer-like coil system having a primary and secondary coil and which overcomes the disadvantages of prior arrangements so as to ensure perfect functioning even when subjected to repeated firings.

According to the present invention, the missiles may be projectiles, rockets or similar objects. Furthermore, the electrical energy to be transmitted in the contactless manner, while preferably serving as an energy supply for an electrical detonator, may also be utilized to supply energy to control circuits for executing certain operations such as an arming or ejection process during the flight phase of the missile or upon the missile's arrival at the target.

In accordance with the present invention, the arrangement for the contactless transmission of electrical energy to a missile during firing of the missile from a firing device utilizing a transformer-like coil system includes a primary-side coil system connected to the firing device and a secondary-side coil system connected to the missile, and a fixed partition of a nonmagnetic material arranged between the primary and secondary coil systems and capable of withstanding the thermal and mechanical stresses of repeated firings, the partition being fixedly connected with the firing device and sealing the primary-side coil system with respect to the missile.

According to a feature of the present invention, the partition is preferably of titanium. However, the partition may also be formed of, for example, tantalum, nickel alloys, brass alloys, or in certain cases also aluminum or copper, depending on the required strength. The mechanically firm partition of nonmagnetic material constitutes reliable protection for the coil system on the primary side, in that the partition seals off this system in a gastight fashion against the gases liberated during firing of the missile. The partition, even at high temperature as they occur during the action of the hot propellant gases of a projectile or a rocket, can readily be constructed with such a strength that it withstands perfectly, just as the remaining parts of the firing device, the occuring pressure loads, the thermal, corrosive, and other stresses, even with a plurality of rapidly repeated firings. It is, thus, advantageously possible during firing of a missile to transmit to the latter electric energy from the outside without having to equip the firing device with mechanical perforations of any type, through which the gases effecting the acceleration of the missile could be undesirably discharged or could act on other components.

A further disadvantage of the conventional arrangements for the contactless transmission of electric energy to detonator resides in that these are operated with an AC voltage of a low frequency of about 50 Hz applied to the primary side. In this connection, it is of importance that the coil systems, after activation of the AC voltage, require a building-up time, and sufficient energy for activating the electric detonator can be transmitted only in the built-up condition. This idle time between instant of activation and attainment of built-up condition results in an undesirable delay of detonation or ignition.

In order to obtain a maximally instant, contactless transmission of the electrical energy for the electric detonator or other electrical systems of missiles during the firing thereof, according to a feature of the present invention, the arrangement includes a pulse generator for producing pulse sequences of a relatively high frequency, preferably in the range from 1 to 50 kHz, especially 15–30 kHz and with maximally steep flanks, the pulse generator being connected in front of the primary-side coil system for introducing the sequence of pulses into the coil system on the primary side. The rapidly repeated, individual, surge-like pulses have an at least approximately rectangular characteristic. This arrangement not only advantageously provides a shortening of the building-up time, but also a large change of the magnetic flux per unit time in the secondary-side coil system, whereby the number of turns of the latter can be reduced with the voltage induced therein being at the same level. A smaller secondary coil is advantageous, for example, if the secondary-side coil system is part of a combustible propellant charge igniter.

In the arrangement for contactless energy transmission described in DOS No. 2,734,169 the secondary coil system is associated with a shielding plate of magnetically saturable iron to obtain protection against external electromagnetic interference fields—as they occur, for example, in radar units, radio transmitters, or atmospheric discharges. The magnetic properties and, thus, the protective effect of such a shielding plate are, however, dependent on numerous parameters, e.g., temperature, frequency, mechanical stress, thickness, surface treatment, and corrosion. As such, the protective effect of the shielding plate is subject to indefinable variations due to environmental influences, mechanical stresses, and material characteristics, and, consequently, is unsatisfactory.

According to another feature of the present invention, the arrangement includes an electrical filter system connected after the secondary coil for interference field shielding purposes. This filter system has a frequency-dependent damping behavior adjusted in such a way that a pulse sequence in the secondary coil system is passed through if it has been induced by a defined pulse sequence with the intended or proper frequency introduced into the primary coil system, and, thus, exhibits likewise the intended frequency, but a pulse sequence having a higher or lower frequency than the intended one is blocked. The term "intended frequency" is understood to mean the frequency with which the desired activation of the primary coil system is effected. The filter system, depending on the requirements of each particular case, can be designed, for example, as a low-pass filter or a high-pass filter, which blocks or passes through all frequencies below or above a limit frequency. However, preferably, a band-pass filter is employed which passes signals between two limit frequencies but acts to block signals below and above such frequencies. With such a coupling of the secondary coil system and the filter system, an effective, controlled shielding against electromagnetic interference fields can be obtained in a very simple and yet reliable fashion.

An especially advantageous arrangement of the coil system on the secondary side is obtained in accordance with the present invention by arranging the secondary coil system in a housing exhibiting two opposed recesses at least substantially separated by an intermediate bottom member of the housing. One of the recesses is of annular shape delimited by a pin-shaped core extending from the intermediate bottom member and accommodates the secondary coil system in the manner of a resonant cavity half shell whereas the other recess serves for accommodating electrical components connected after the secondary coil system. Thus, the housing for accommodating the coil system simultaneously constitutes the secondary resonant cavity half shell for this system and, furthermore, serves for housing the remaining electronic components connected after the coil system, as well as the optionally provided detonator or primer charge. Accordingly, a compact unit of minimum structural size is obtained which, for example, also withstands the high acceleration forces in automatic firearms.

According to another feature of the present invention, the housing is made, for example, for combustible electric propellant charge igniters, of a combustible nonmetallic material such as a propellant charge powder or a synthetic resin, optionally in a mixture with an explosive. Particles of a magnetic and/or an electrically conductive material are incorporated or embedded in the housing so as to obtain reinforcement of the magnetic flux penetrating the secondary coil and/or a redundant shielding of the entire secondary-side coil system with respect to sources of interference radiation.

If combustibility of the secondary coil system is required, it proves furthermore advantageous according to a further feature of the present invention to make the secondary coil of a wire yielding energy during its conversion or combustion. A pyrometal, which is obtainable commercially and utilized, for example, for wire fuzes, can be employed for this purpose. The pyrometal is built-up essentially as a bimetallic mixture on the basis of palladium-aluminum or platinum-aluminum and once this pyrometal has been heated up to the conversion temperature characteristic therefor (generally an elevated temperature), it reacts exothermally under alloy formation and is deflagratingly combusted without oxygen supply.

These and other objects, features, and advantages of the present invention will become more apparent from the following description when taken with the accompanying drawings which show, for the purposes of illustration only, one embodiment in accordance with the present invention, and wherein.

Figure 1:
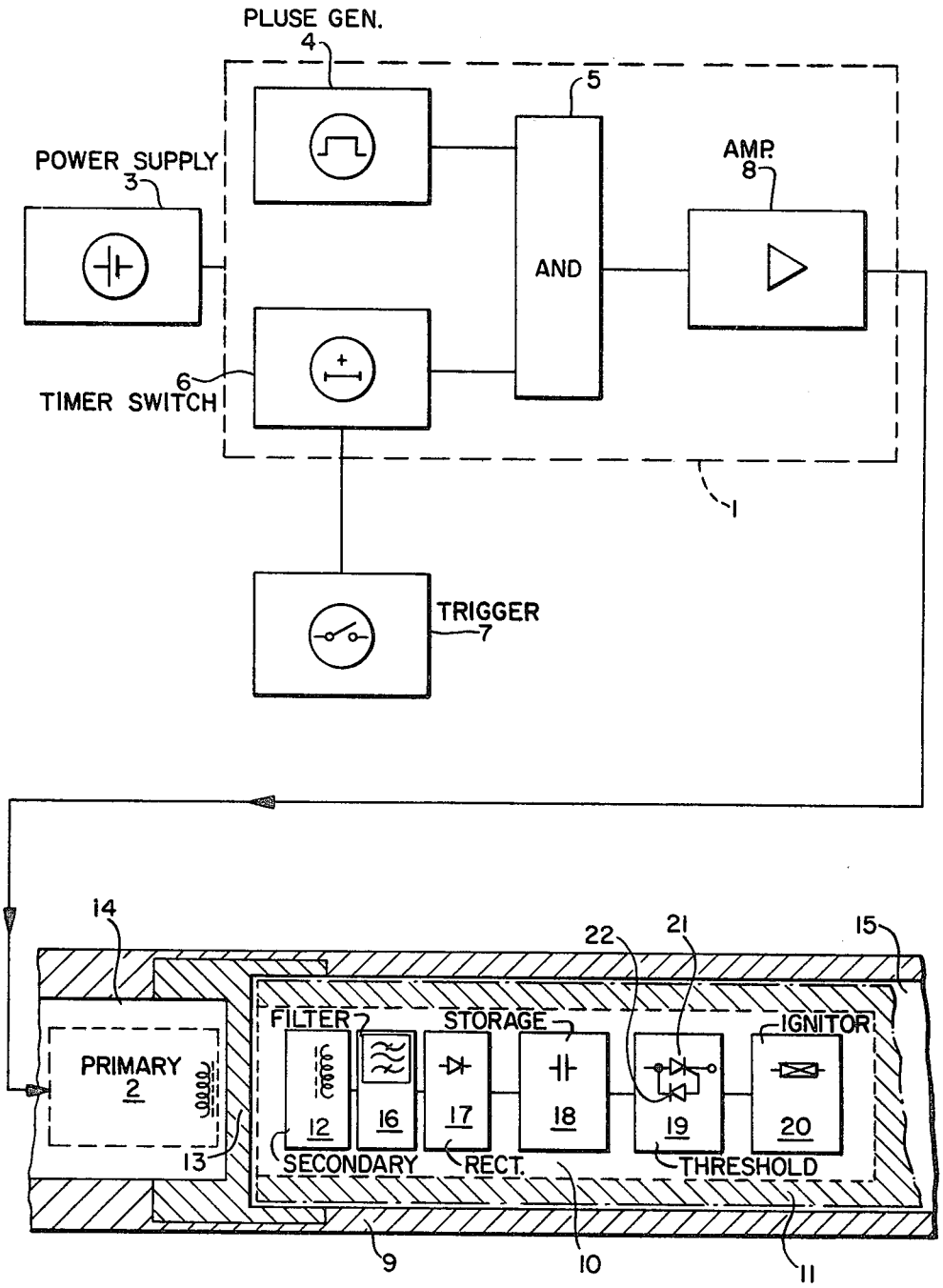
FIG. 1 shows generally in block diagram form an arrangement for the contactless transmission of electrical energy in accordance with the present invention.

Referring now to the drawings wherein like reference numerals are utilized to designate like parts throughout the several figures, there is shown in FIG. 1 the arrangement of the present invention including a primary circuit constituted by a control circuit 1 and a primary-side coil system 2. The control circuit 1 and/or its component groups described hereinbelow are operated at DC or AC voltage by means of the current supply 3. The voltage is preferably between 12 and 240 V. A pulse generator 4 of the control circuit 1 serves for the production of successive rectangular pulses at an adjustable frequency. The pulse sequence is fed to a first input of an AND gate 5. The second input of the AND gate is connected with a timer switch 6, the operating time of which is settable and is adapted to the level of energy to be transmitted. The timer switch 6 is activated by a trigger 7 and transmits a voltage to the second input of the AND gate 5 only during its predetermined operating time t. Thus, the pulse sequence transmitted by the pulse generator 4 is obtained at the output of the AND gate 5 as a temporarily limited pulse group and is fed to a power amplifier 8 connected thereafter, which, in turn, is coupled with the primary coil system 2. The primary coil system is embedded in a resonator cavity half shell or a similar component, not shown, which is conventionally constructed in correspondence with the frequency relationships thereof, the primary coil system 2 being arranged within a firing device 9 illustrated as a barrel of a firearm.

The secondary circuit is constructed as a detonation or initiating circuit 10 which is part of a propellant charge igniter 11, indicated merely symbolically of a missile to be fired. The propellant charge igniter 11 is shown for illustrative purposes, in a deviation from reality, as filling practically the entire inside cross-section of the barrel 9. The initiating cirucit 10 includes a secondary-side coil system 12, the turns of which consist of a pyrophoric wire and, thus, can be exothermally reacted.

Between the two coil systems 2, 12, a high-strength partition 13 is arranged which is of a nonmagnetic material, preferably titanium. The partition 13 hermetically seals the breech part 14 of the barrel 9 and, thus, also the primary-side coil system 2 with respect to the cartridge chamber and the combustion chamber 15 of the barrel 9 and, thus, with respect to a projectile representing the missile, to be arranged therein. A mechanical perforation of the wall of the combustion chamber is unnecessary for transmitting the electrical detonation ignition energy.

After operation of the trigger 7, a group of pulses is available at the secondary coil system 12 which is equivalent to the signal at the primary coil system 2 in correspondence with the induction principle in a transformer system. A filter 16 is connected after the secondary coil system 12, and is constructed, for example, as a band-pass filter passable only in the frequency range of the intended ignition pulse at the primary coil system and, thus, effecting the blocking out of interfering radiation sources. This ensures that only the pulse group induced by the intended ignition signal can pass the filter 16 to charge the subsequently connected ignition energy storage device 18 such as a capacitor, via a rectifier element 17, for example, a diode. The ignition energy storage device 18 is connected via an electronic threshold value switch 19 to an electrical igniter element 20. The threshold value switch 19 has the effect that the charge of capacitor 18 is transmitted to the igniter element 20 only after surpassing a definite ignition voltage threshold. For this purpose, the switch is constructed, for example, as a thyristor or field effect transistor 21 connected between the capacitor 18 and igniter element 20, the control input of the switch 19 being connected via a Zener diode 22 to the capacitor. The Zener voltage, thus, determines the ignition voltage threshold. If this threshold is exceeded at capacitor 18, the Zener diode 22 becomes conductive and the thyristor or field effect transistor 21 is actuated, i.e., it becomes extremely low-ohmic and, thus, the stored energy of the capacitor 18 is transmitted to the igniter element 20 and the latter is triggered.

Figure 2:
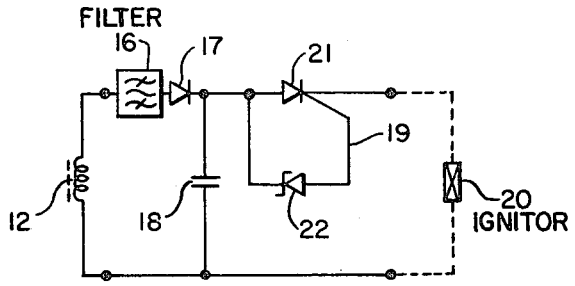
FIG. 2 is a circuit diagram of the secondary circuit in accordance with the present invention.

FIG. 2 illustrates the circuit diagram of the initiating circuit 10 from the viewpoint of circuit technology for contactless electrical ignition of primary explosives. The igniter element 20 is connected with the remaining circuit by dashed lines and this circuit—as explained in connection with FIG. 3—constitutes an inherently closed compact block.

Figure 3:
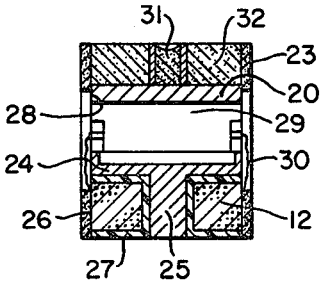
FIG. 3 shows a constructional arrangement of the secondary circuit in accordance with the present invention.

FIG. 3 shows a constructional arrangement for the secondary circuit and in a longitudinal sectional view in approximately twofold enlargement. A housing 23 consists of a combustible mixture of propellant charge powder and particulate magnetic and electrically conductive material, for example, iron powder. Suitable propellant charge powders are, for example, nitrocellulose, double-base, triple-base, or multiple-base powders, or also so-called composite propellant charge materials. The propellant charge powder can also be replaced partially or wholly by explosives, optionally in a mixture with binders. Suitable explosives are primary as well as secondary explosives, e.g., octogen, especially α-octogen, hexanitrostilbene, triaminoguanidine nitrate, hexanitrodiphenyl ether, or dipicrysulfone. Binders are especially polyester resins, but also suitable are polyurethanes or other synthetic resins which are combustible without difficulties.

The housing 23 has an intermediate bottom member 24 having a pin-shaped axial core 25 integrally formed with and extending therefrom to delimit an annular recess 26 wherein the secondary-side coil system 12 of a pyrophoric, exothermally reacting wire is accommodated. The system 12 is mounted on a combustible coil carrier 27 of, for example, a synthetic resin. The housing 23, thus, simultaneously constitutes a resonant cavity half shell for the coil system 12, the content of particulate magnetic material ensuring magnetic transmission. The amount of this material is optimized for the particular case in a conventional manner, in correspondence with the required magnetic properties in dependence on the number of turns of the secondary coil 12, the intended frequency, housing strength, combustibility, etc.

The electronic system of the secondary initiating circuit is arranged as a compact block 29, shown in plan view and having a combustible sealing compound, in a recess 28 on the other side of the closed intermediate bottom member 24. A suitable sealing compound can be, for example, epoxy resins or unsaturated polester resins. The coil system 12 is connected to the electronic system via two conductors 30. The igniter element 20 is preferably a layered metal element according to German Pat. No. 2,020,016 and is held in touching contact with the electronic system 29. The igniter substance 31 on the basis of an initiating explosive is applied to the layered metal element 20 and is accommodated in an annular carrier or support 32 made of a combustible sealing compound. The housing 23 represents additionally a redundant shield for the entire combustible secondary initiating circuit against sources of interfering radiation, due to the incorporated particles of a magnetic and/or electrically conductive material.

This secondary initiating circuit is preferably utilized as a combustible, electric propellant charge igniter exhibiting a magnetically conductive housing, a miniature electronic system, and a layered metal element, and being wholly combustible or vaporizable down to minimal pulverized silicon crystals, aluminum oxide particles, or the like, pertaining to the electronic circuit.

Figure 4:
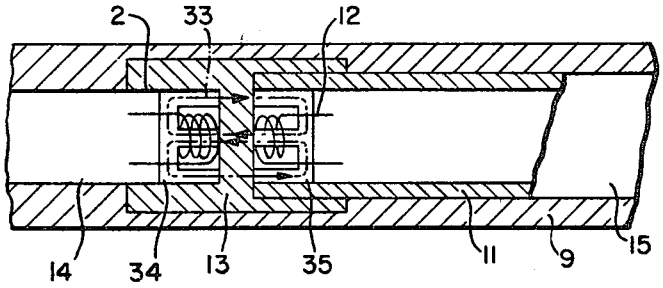
FIG. 4 illustrates the principle of electrical energy transmission in accordance with the present invention.

FIG. 4 shows the magnetic field lines 33 emanating from the primary-side coil system 2 with an associated resonant cavity half shell 34, penetrating the partition 13, and inducing a corresponding voltage in the secondary-side coil system 12 with an associated resonant cavity half shell 35 according to the transformer principle. The resonant cavity half shells, although illustrated in cross-sectional view, have not been shaded for illustrative reasons. The transmission of the detonating or ignition energy takes place without mechanical perforations of the combustion chamber 15. The fact that the partition 13 is made of a nonmagnetic material prevents short-circuiting of the magnetic lines of flux between the two coil systems 2, 12.

While we have shown and described only one embodiment in accordance with the present invention, it is understood that the same is not limited thereto but is susceptible of numerous changes and modifications as known to one having ordinary skill in the art and we, therefore, do not wish to be limited to the details shown and described herein, but intend to cover all such modifications as are encompassed by the scope of the appended claims.

What is claimed is:

1. An arrangement for the contactless transmission of electrical energy to a missile during the firing thereof from a firing device, the arrangement comprising a transformer-like coil system including a primary coil system connected to the firing device and a secondary coil system connected to the missile, the primary coil system being supplied with electric energy and the secondary coil system being responsive to the electric energy developed in the primary coil system for developing electrical energy therein, partition means arranged between the primary coil system and the secondary coil system, the partition means comprising a nonmagnetic material and being capable of withstanding thermal and mechanical stresses of repeated firings by the firing device, the partition means being fixedly connected with the firing device and disposed for sealing the primary coil system with respect to the missile at least during the firing of the missile from the firing device, and a housing having two opposed recesses and an intermediate bottom member for at least substantially separating the two recesses, a pin-shaped core extending from the intermediate bottom member so as to delimit an annular shape for one of the two recesses and the housing, the one of the two recesses and the housing forming a resonant cavity half shell for accommodating the secondary coil system therein, the other of the two recesses and the housing being arranged for accommodating electrical components connected to the output of the secondary coil system.

2. An arrangement according to claim 1, wherein the partition means is a mechanically firm member formed of one of titanium, tantalum, nickel alloy, brass alloys, aluminum and copper, the member providing a gas tight seal of the primary coil system with respect to gases generated during firing of the missile.

3. An arrangement according to claim 1, further comprising pulse generator means for supplying pulse sequences to the primary coil system to develop electric energy therein.

4. An arrangement according to claim 3, wherein the pulse generator means produces pulses having a substantially rectangular form in sequences of a frequency in the range of 1–50 kHz.

5. An arrangement according to claim 1, wherein the electrical components include electrical filter means connected to the output of the secondary coil system, rectifier means connected to the output of the filter means, electrical energy storage means connected to the output of the rectifier means, and threshold switching means connected to the output of the electrical storage for passing the electrical energy of the storage means to a utilization means upon reaching a predetermined threshold.

6. An arrangement according to claim 5, wherein the utilization means includes ignitor means for the missile, the ignitor means comprising a metal layered element connected to the threshold switching means for igniting an explosive, the igniter means and explosive being accommodated in the other of the two recesses of the housing, and the housing being connected to the missile.

7. An arrangement according to claim 1, wherein the housing is combustible and formed of a nonmetallic material having at least one of magnetic and electrically conductive particles embedded therein.

8. An arrangement according to claim 7, wherein the secondary coil system comprises electrically conductive wire consisting of a metallic material which reacts exothermally.

9. An arrangement according to claim 8, wherein the conductive wire is a pyrophoric wire reacting exothermally at an elevated temperature.

10. An arrangement according to claim 1, further comprising gating means coupled between pulse generator means and the primary coil system for gating pulse groups supplied by the pulse generator means to the primary coil system to develop electrical energy therein.

11. An arrangement according to claim 1, further comprising electric filter means connected to the output of the secondary coil system, the filter means having a pass range adapted to pulse sequence introduced into the primary coil system for passing electrical energy within the pass range.

12. An arrangement according to claim 11, wherein the filter means is a band-pass filter.

13. An arrangement for the contactless transmission of electrical energy to a missile during the firing thereof from a firing device, the arrangement comprising a transformer-like coil system including a primary coil system connected to the firing device and a secondary coil system connected to the missile, the primary coil system being supplied with electric energy and the secondary coil system being responsive to the electrical energy developed in the primary coil system for developing electrical energy therein, partition means arranged between the primary coil system and the secondary coil system, the partition means comprising a nonmagnetic material and being capable of withstanding thermal and mechanical stresses of repeated firings by the firing device, the partition means being fixedly connected with the firing device and disposed for sealing the primary coil system with respect to the missile at least during the firing of the missile from the firing device, and pulse generator means for supplying pulse sequences to the primary coil system to develop electric energy therein, the pulse generator means producing pulses having a substantially rectangular form in sequences of a frequency in the range of 1–50 kHz.

14. An arrangement according to claim 13, wherein the pulse generator means produces pulse sequences of a frequency of 15–30 kHz.

15. An arrangement according to claim 13, further comprising gating means coupled between the pulse generator means and the primary coil system for gating pulse groups supplied by the pulse generator means to the primary coil system to develop electrical energy therein.

16. An arrangement according to claim 13, further comprising electric filter means connected to the output of the secondary coil system, the filter means having a pass range adapted to the pulse sequence introduced into the primary coil system for passing electrical energy within the pass range.

17. An arrangement according to claim 16, wherein the filter means is a band-pass filter.

18. An arrangement for the contactless transmission of electrical energy to a missile during the firing thereof from a firing device, the arrangement comprising a transformer-like coil system including a primary coil system connected to the firing device and a secondary coil system connected to the missile, the primary coil system being supplied with electric energy and the secondary coil system being responsive to the electric energy developed in the primary coil system for developing electrical energy therein, partition means arranged between the primary coil system and the secondary coil system, the partition means comprising a nonmagnetic material and being capable of withstanding thermal and mechanical stresses of repeated firings by the firing device, the partition means being fixedly connected with the firing device and disposed for sealing the primary coil coil system with respect to the missile at least during the firing of the missile from the firing device, and a housing for accommodating the secondary coil system, the housing being combustible and formed of a nonmetallic material having at least one of magnetic and electrically conductive particles embedded therein, the housing being connected to the missile.

19. An arrangement according to claim 18, wherein the secondary coil system comprises electrically conductive wire consisting of a metallic material which reacts exothermally.

20. An arrangement according to claim 19, wherein the conductive wire is a pyrophoric wire reacting exothermally at an elevated temperature.

* * * * *